US007866286B2

(12) United States Patent
Sun

(10) Patent No.: US 7,866,286 B2
(45) Date of Patent: Jan. 11, 2011

(54) METHOD FOR VALVE SEATING CONTROL FOR AN ELECTRO-HYDRAULIC ENGINE VALVE

(75) Inventor: Zongxuan Sun, Plymouth, MN (US)

(73) Assignee: GM Global Technology Operations, Inc., Detroit, MI (US)

( * ) Notice: Subject to any disclaimer, the term of this patent is extended or adjusted under 35 U.S.C. 154(b) by 600 days.

(21) Appl. No.: 11/851,446

(22) Filed: Sep. 7, 2007

(65) Prior Publication Data

US 2008/0066701 A1 Mar. 20, 2008

Related U.S. Application Data

(60) Provisional application No. 60/825,413, filed on Sep. 13, 2006.

(51) Int. Cl.
*F01L 9/02* (2006.01)

(52) U.S. Cl. ..... 123/90.12; 123/90.13; 137/625

(58) Field of Classification Search ..... 123/90.12, 123/90.13; 137/511, 625
See application file for complete search history.

(56) References Cited

U.S. PATENT DOCUMENTS 5,375,419 A 12/1994 Wright et al.
5,638,781 A 6/1997 Sturman
5,680,841 A * 10/1997 Hu ..... 123/322
6,109,284 A 8/2000 Johnson et al.
6,263,842 B1 7/2001 De Ojeda et al.
6,267,351 B1 7/2001 Schneider
6,321,703 B1 11/2001 Diehl et al.
6,371,064 B2 4/2002 Hartke et al.
6,374,784 B1 4/2002 Tischer et al.
6,505,584 B2 1/2003 Lou
6,752,106 B2 6/2004 Hedman
6,886,510 B2 * 5/2005 Sun et al. ..... 123/90.12
6,928,966 B1 * 8/2005 Sun ..... 123/90.12
6,959,673 B2 11/2005 Sun
6,966,285 B1 * 11/2005 Sun ..... 123/90.12
6,971,348 B1 * 12/2005 Sun ..... 123/90.15

OTHER PUBLICATIONS

Turner, CW; Design & Control of a 2 Stage Electro-hydraulic Valve Actuation System; SAE Tech Paper 2004-01-1265; SAE, Warrendale, PA.

Misovec, KM; Digital Valve Technology Applied of the Control of an Hydraulic Valve Actuator; SAE Tech Paper 1999-01-0825; SAE, Warrendale, PA.

* cited by examiner

*Primary Examiner*—Ching Chang

(57) ABSTRACT

Valve lift in an internal combustion engine is controlled by an electro-hydraulic actuation mechanism including a selectively actuable hydraulic feedback circuit.

12 Claims, 3 Drawing Sheets

METHOD FOR VALVE SEATING CONTROL FOR AN ELECTRO-HYDRAULIC ENGINE VALVE

CROSS REFERENCE TO RELATED APPLICATIONS

This application claims priority from U.S. Provisional Application No. 60/825,413, filed on Sep. 13, 2006, which is hereby incorporated herein by reference.

GOVERNMENT LICENSE RIGHTS

The U.S. Government has a paid-up license in this invention and the right in limited circumstances to require the patent owner to license others on reasonable terms as provided for by the terms of contract number NDG 024100 awarded by the Department of Energy.

TECHNICAL FIELD

This disclosure is related to actuation and control of a valve train for an internal combustion engine.

BACKGROUND

The statements in this section merely provide background information related to the present disclosure and may not constitute prior art.

Fully flexible valve actuation (FFVA) systems also referred to as camless systems, include electro-magnetic (electro-mechanical), electro-hydraulic and electro-pneumatic systems. Known electro-magnetic systems are able to generate controllable valve opening timing and duration. These devices, however, generally have high valve-seating velocities. They are also limited by having fixed valve lift operation. Known electro-hydraulic systems provide fully controllable valve-lift events. For these systems, digital and/or proportional valves have been implemented to control hydraulic fluid flow to open and close the engine valve. Potential issues with the electro-hydraulic mechanisms may include system controllability and energy consumption. Known electro-pneumatic systems employ pneumatic actuators to open and close the engine valve. Potential issues with the electro-pneumatic system include low power density and leakage.

SUMMARY

An internal combustion engine includes an electro-hydraulic actuation mechanism operative to urge a moveable engine valve to a lift. A method for operating the electro-hydraulic actuation mechanism comprises equipping the electro-hydraulic actuator with a selectively actuable hydraulic feedback circuit. The engine valve is commanded to a desired lift, and the electro-hydraulic actuator is controlled to urge the engine valve to the desired lift. Lift of the engine valve is monitored, and the hydraulic feedback circuit is actuated when the monitored lift of the engine valve approaches the desired lift.

BRIEF DESCRIPTION OF THE DRAWINGS

One or more embodiments will now be described, by way of example, with reference to the accompanying drawings, in which.

DETAILED DESCRIPTION

Figure 1:
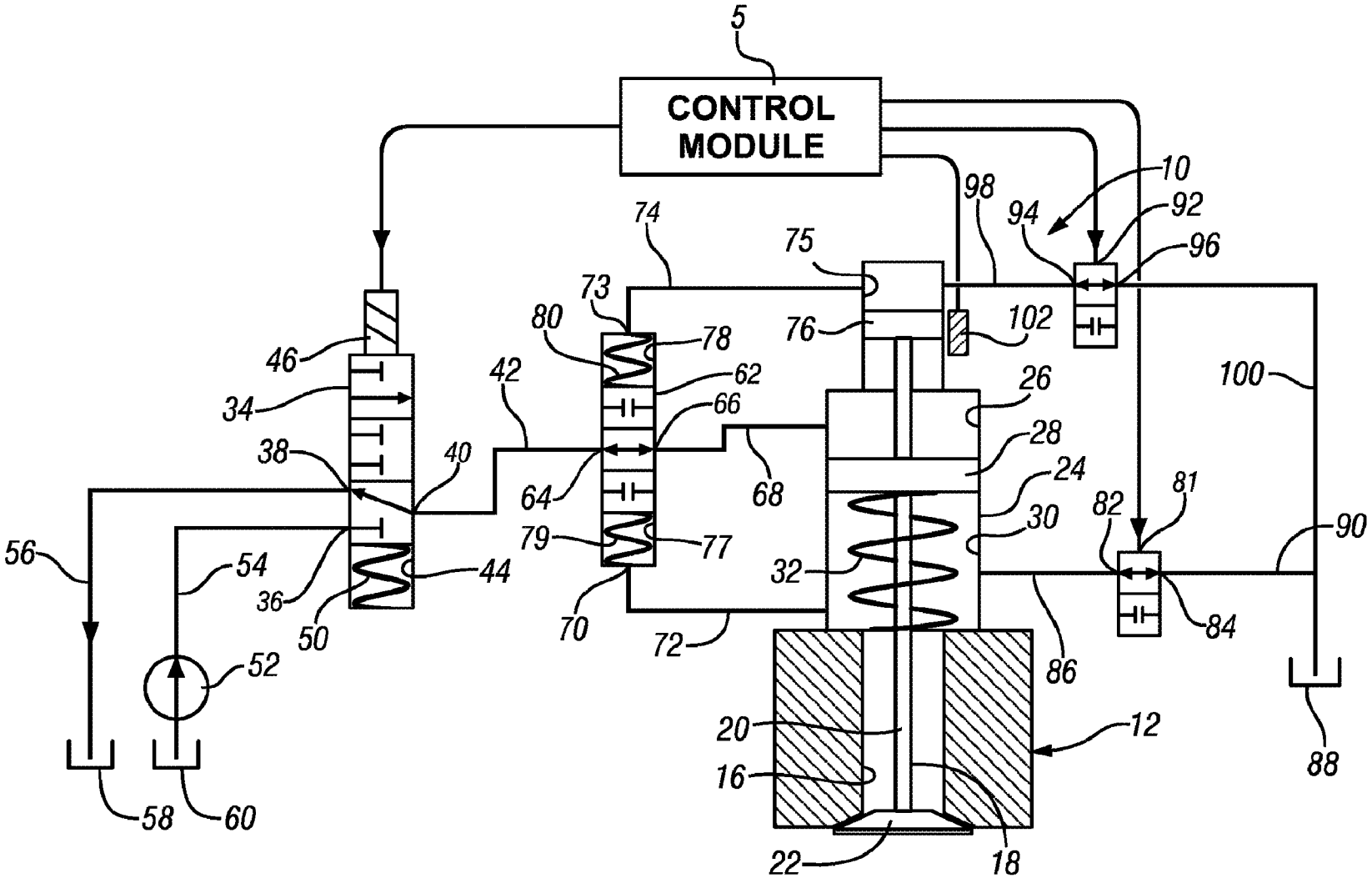
FIG. 1 is a schematic illustration of a fully flexible electro-hydraulic valve actuation system in accordance with the present disclosure.

Referring now to the drawings, wherein the showings are for the purpose of illustrating certain exemplary embodiments only and not for the purpose of limiting the same, FIG. 1 schematically depicts a non-limiting electro-hydraulic valve actuator assembly 10 and engine valve 18 on which the disclosure is applicable. The illustrative electro-hydraulic valve actuator assembly and engine valve are described in commonly assigned U.S. Pat. No. 6,959,673 B2, which is incorporated herein by reference in its entirety.

The electro-hydraulic valve actuator assembly 10 is mounted on a cylinder head 12 of an internal combustion engine, and controlled by an electronic control module 5. The cylinder head 12 includes a plurality of openings 16 leading to combustion chambers of the internal engine. Each opening has a moveable engine valve 18. Flow of intake and exhaust gases through the combustion chambers is controlled by opening and closing of the engine valves 18. Each engine valve 18 is either an intake valve, controlling flow of filtered intake air into the combustion chamber for combustion, or an exhaust valve controlling flow of exhaust gases out of the combustion chamber. The engine valve 18 includes a valve stem 20 and a valve head 22 at one end of the valve stem. The engine valve 18 is movable between open and closed positions, referred to as lift, to control flow through the opening 16. Preferably there is a single electro-hydraulic valve actuator assembly 10 for each engine valve.

The electro-hydraulic valve actuator assembly 10 includes a valve housing 24, preferably mounted on the head 12. The valve housing 24 has a main fluid chamber 26 therein. The valve actuator assembly 10 also includes a first piston 28 connected to or in contact with the valve stem 20 of the engine valve 18. The first piston 28 is disposed in the main chamber 26 of the valve housing 24 and forms a second fluid chamber 30 therein. There is an engine valve spring 32 disposed about the valve stem 20 between the engine head and the first piston to bias the engine valve 18 toward the closed position. The valve head 22 closes the opening 16 when the engine valve 18 is in the closed position.

The valve actuator assembly 10 includes a first spool valve 34 fluidly connectable to the main chamber 26 of the valve housing 24 via a second spool valve 62. The first spool valve 34 is of a three-position three-way type. When the first spool valve 34 is in a first position, a high pressure port 36 selectively fluidly connects to a first fluid chamber port 40 which is fluidly connected by an intermediate channel 42 to the second spool valve 62, and a low pressure port 38 is closed. When the first spool valve 34 is in a third position, the low pressure port 38 selectively fluidly connects to the first fluid chamber port 40 which is fluidly connected by intermediate channel 42 to the second spool valve 62. When the first spool valve 34 is in a second position, the high pressure port 36, the low pressure port 38 and the first fluid chamber port 40 are closed. There is an actuator 46 at one end of the first spool valve 34 opposite a chamber 44. The actuator 46 preferably comprises a linear solenoid operatively connected to the control module 5. The valve actuator assembly 10 further includes a first spool valve spring 50 disposed in the chamber 44 to bias the first spool valve 34 toward the actuator 46. The control module energizes and de-energizes the actuator 46 to move the first spool valve 34 to the first position to effect high pressure flow, to the third position to effect low pressure drain, and to the second position for flow interruption, in accordance with the control scheme described hereinbelow with reference to FIG. 2.

The valve actuator assembly 10 includes a fluid pump 52 preferably comprising an electrically controlled fluid pumping device operative to draw fluid from sump 60, and pump it to a high pressure line 54 fluidly connected to the fluid pump 52 and the high pressure port 36. The valve actuator assembly 10 includes a fluid tank 58 and a low pressure line 56 fluidly connected to the fluid tank 58 and the low pressure port 38. The fluid pump 52 may be fluidly connected to the fluid tank 58 or sump 60.

The valve actuator assembly 10 includes a third fluid chamber 75 in the valve housing 24. The valve actuator assembly 10 also includes a second piston 76 connected to the first piston 28. The second piston 76 is disposed in the third fluid chamber 75 of the valve housing 24. The valve actuator assembly 10 includes the second spool valve 62 fluidly connected to the main chamber 26 of the valve housing 24 and the first spool valve 34. The second spool valve 62 comprises a three-position two-way type valve, having positions I, II, and III, as described hereinbelow. There is a first port 64 fluidly connected by the intermediate channel 42 to the first spool valve 34 and a second port 66 fluidly connected by a driving channel 68 to the main chamber 26. There is a third port 70 fluidly connected by a first feedback channel 72 to the secondary fluid chamber 30 and a fourth port 73 fluidly connected by a second feedback channel 74 to the third fluid chamber 75. The second spool valve 62 controls fluid flow to the main chamber 26 of the valve housing 24. When the second spool valve 62 is in position II, hydraulic fluid is permitted to pass between the first port 64 and the second port 66. When the second spool valve 62 is in position I, hydraulic fluid is not permitted to pass between the first port 64 and the second port 66. When the second spool valve 62 is in position III, fluid communication between the first port 64 and the second port 66 is not permitted to pass, as depicted in FIG. 1. In an alternative embodiment, when the second spool valve 62 is in position III, fluid communication between the first port 64 and the second port 66 is restricted, utilizing an orifice of predetermined size (not shown). There is a fourth fluid chamber 77 at one end fluidly connected to the third port 70, and a fifth fluid chamber 78 at a second end opposite the fourth fluid chamber 77 fluidly connected to the fourth port 73. Spool valves 34, 62, and chambers 44, 77, 78, and channels 42, 68, 72, 74 are preferably physically integrated into the valve housing 24. There is a second spool valve spring 79 disposed in the fourth fluid chamber 77 to bias the second spool valve 62 toward the fifth fluid chamber 78. There is a third spool valve spring 80 disposed in the fifth fluid chamber 78 to bias the second spool valve 62 toward the fourth fluid chamber 77. Under stasis hydraulic pressure conditions, the springs 80 and 79 maintain the spool valve 62 in Position II. Fluid pressure in the fifth fluid chamber 78 that overcomes the force of the second spool valve spring 79 is operative to move the second spool valve 62 to Position III. Fluid pressure in the fourth fluid chamber 77 that overcomes the force of the third spool valve spring 80 is operative to move the second spool valve 62 to Position I.

The valve actuator assembly 10 includes the first on/off flow valve 81 fluidly connected to the second fluid chamber 30 of the valve housing 24. The first on/off valve 81 is of a two position two-way type and is operatively connected to the control module 5. The first on/off valve 81 has a first port 82 and a second port 84. The first port 82 is fluidly connected by a channel 86 to the second fluid chamber 30. The valve actuator assembly 10 includes a fluid tank 88 fluidly connected to the second port 84 by a low pressure line 90. Fluid tank 88 is a low pressure source or sump.

The valve actuator assembly 10 includes the second on/off flow control valve 92 fluidly connected to the third fluid chamber 75 of the valve housing 24. The second on/off flow control valve 92 is a two position two-way type and is operatively connected to the control module 5. The second on/off flow control valve 92 has a first port 94 and a second port 96. The first port 94 is fluidly connected by a channel 98 to the third fluid chamber 75. The valve actuator assembly 10 includes the fluid tank 88 fluidly connected to the second port 96 by a low pressure line 100.

The valve actuator assembly 10 further includes a linear position sensor 102 adapted to monitor magnitude of lift of the engine valve 18, from which valve lift, seating velocity, opening and closing velocity, trajectory and timing can be determined. The linear sensor is signally connected to the control module 5.

A control system comprising the electronic control module 5 monitors engine operation. The control module 5 is preferably a general-purpose digital computer generally comprising a microprocessor or central processing unit, storage mediums comprising read only memory (ROM), random access memory (RAM), electrically programmable read only memory (EPROM), a high speed clock, analog to digital (A/D) and digital to analog (D/A) circuitry, and input/output circuitry and devices (I/O) and appropriate signal conditioning and buffer circuitry. The control module 5 has a set of control algorithms, comprising resident program instructions and calibrations stored in ROM and executed to provide respective functions.

The second spool valve 62, feedback channels 72 and 74, and first and second on/off flow control valves 81, 92 form selectively actuable hydraulic feedback circuits internal to the valve actuator assembly 10 by which the electronic control module 5 controls opening and closing of the engine valve 18 in conjunction with the first valve 34. The control module provides overall operating control of the engine, including determining and controlling opening phasing, lift magnitude, and duration of opening of a plurality of the engine valves 18 by controlling each valve actuator assembly 10, including valves 34, 81, and 92 and monitoring output of sensing device 102. This is now described.

Figure 2:
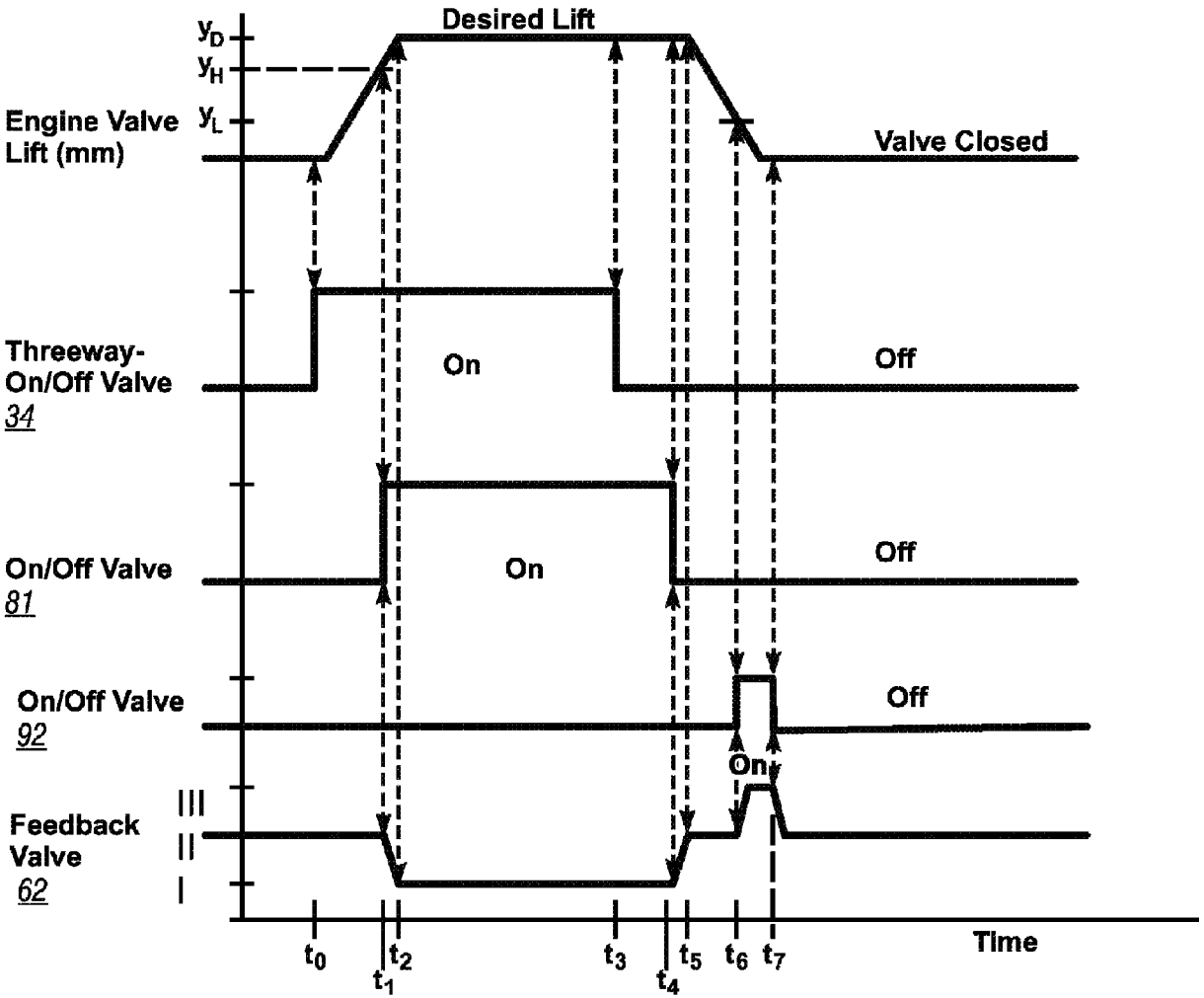
FIG. 2 is a graphical representation of a timing chart in accordance with the present disclosure.
Figure 3:
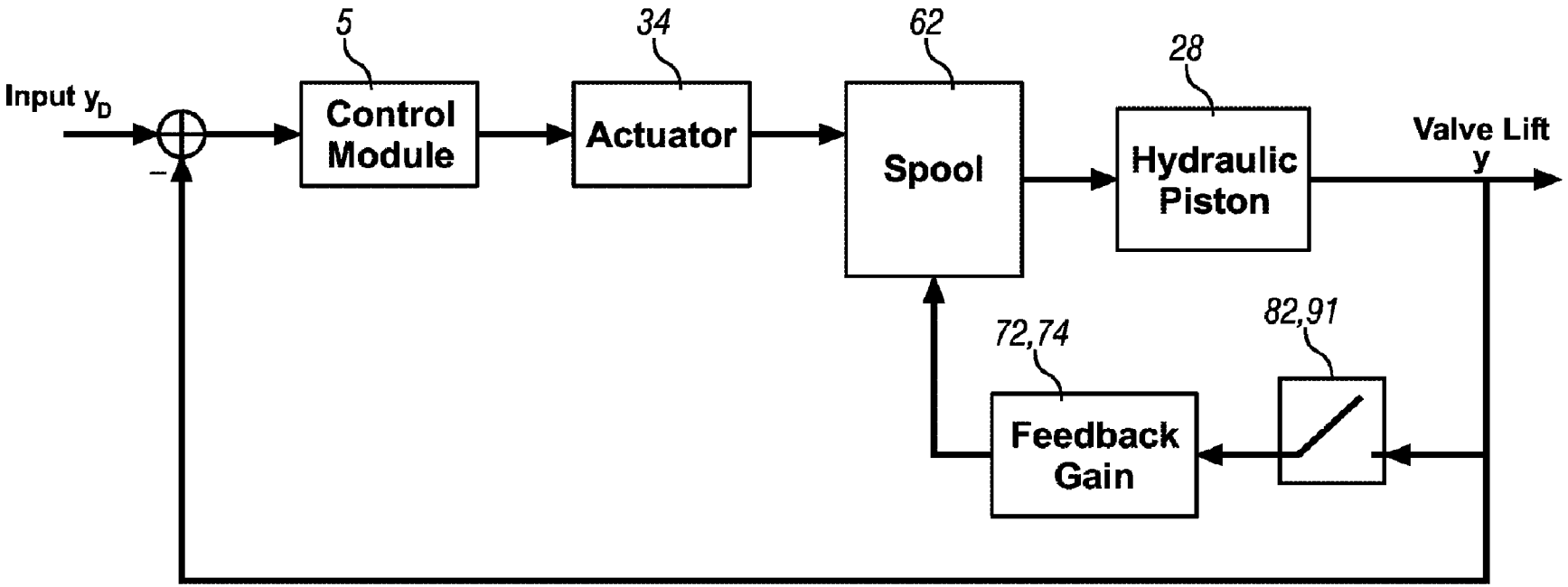
FIG. 3 is a schematic illustration of a control scheme in accordance with the present disclosure.

Referring now to FIG. 3, a schematic diagram depicts a control scheme which is embodied in the electro-hydraulic valve actuation system depicted in FIG. 1, including numerals identifying specific elements thereof. There is a commanded valve lift, $y_D$, which is compared to a measured valve lift, y, determined from position feedback. An error term is generated and input to the control module 5. In operation, the control module 5 commands actuator 34 which controls the hydraulic spool valve 62. The hydraulic spool valve 62 controls the hydraulic piston 28 operative to urge the engine valve to a lift. As the hydraulic piston lifts the engine valve, a hydraulic feedback circuit is selectively actuated at a predetermined lift of the engine valve, through selective actuation of one of valves 82, 91. When the hydraulic feedback circuit is actuated, a feedback gain, in the form of the hydraulic lines 72, 74, acts upon the hydraulic spool valve 62 to control the operation of the hydraulic piston 28 and hence the lift, y, of the engine valve. Non-limiting operation of this control scheme is now described in detail with reference to FIG. 2.

FIG. 2 is a time-based graphical depiction of operation of the valves 34, 81, and 92 and feedback valve 62 of the electro-hydraulic actuator 10 to control lift, y, of the engine valve, including softly seating and closing thereof. The engine control module executes algorithms to determine appropriate timing for opening and closing each of the engine intake and exhaust valves based upon operator demands, engine crankshaft position and rotational speed, and opening response time of the electro-hydraulic valve actuator assembly 10. The engine valve 18 is initially in the closed position, as depicted in FIG. 1. When the engine valve 18 is in the closed position, the actuator 46 is de-energized by the control module 5, and the first spool valve spring 50 pushes the first spool valve 34 to the third position and exposes the intermediate channel 42 to the low pressure line 56. The on/off flow control valves 81 and 92 are open, exposing both the second fluid chamber 30 and the third fluid chamber 75 to the fluid tank 88. The second spool valve spring 79 and third spool valve spring 80 maintain the second spool valve 62 in Position II, and the main chamber 26 is connected to the low pressure line 56 through the driving channel 68 and the intermediate channel 42. The engine valve spring 32 maintains the engine valve 18 in the closed position.

In operation, at time $t_0$, the control module 5 commands opening of the valve 18 to a desired lift, $y_D$, comprising a predetermined lift magnitude, typically in the range of one millimeter (1 mm) to twelve millimeters (12 mm). The control module energizes actuator 46 to switch the first spool valve 34 to the first position to allow flow of pressurized fluid from high pressure port 36 to the main chamber 26 through second spool valve 62. High-pressure fluid enters the main chamber 26 through the driving channel 68, and overcomes the bias force exerted by the engine valve spring 32, thus effecting opening of the engine valve 18. The intermediate channel 42 is exposed to the high pressure line 54. The on/off valves 81 and 92 are open, connecting the second fluid chamber 30 and the third fluid chamber 75 to the low pressure fluid tank 88.

When the engine valve 18 approaches the desired lift, $y_D$, the control module triggers lift control, at time $t_1$, by closing the first on/off valve 81. The time, $t_1$, at which the control module closes the first on/off valve 81 is determined based upon the engine valve being opened to a position-certain a predetermined distance from the desired lift, depicted as $y_H$. Thus when the engine valve reaches the desired predetermined lift, $y_H$, as determined by input from sensor 102, the controller 5 energizes and closes the first on/off valve 81, disconnecting the fluidic connection between the second fluid chamber 30 and the fluid tank 88.

The closing of the first on/off flow control valve 81 triggers the internal hydraulic feedback control, stopping the opening of the engine valve 18 at the desired lift. The engine valve 18 continues opening due to hydraulic pressure in the main chamber 26, and the movement of the first piston 28 forces flow of fluid from the second fluid chamber 30 into the fourth fluid chamber 77 via the feedback channel 72. The second spool valve 62 moves to Position I when there is sufficient volumetric flow and corresponding pressure increase in the fourth fluid chamber 77. The movement of the second spool valve 62 to Position I terminates the fluid connection between the driving channel 68 and the intermediate channel 42, discontinuing the opening the engine valve 18, at time $t_2$. The engine valve is held open at the desired lift, $y_D$, by the hydraulic pressure in the main chamber 26. This operation comprises the internal feedback mechanism controlling the valve lift.

The engine valve is closed by the control module controlling actuator 46 to move the spool valve 34 to the third position, fluidly connecting the low pressure port 38 to the first fluid chamber port 40 which is fluidly connected by intermediate channel 42 to the second spool valve 62, at time $t_3$. This happens at any time during the period when the engine valve is open. Subsequently the first on/off valve 81 is controlled to an open position, at time $t_4$, connecting the second fluid chamber 30 to the fluid tank 88. Subsequently at time $t_5$, pressures in channels 72 and 74 have equilibrated sufficiently permitting the second spool valve spring 79 and third spool valve spring 80 to urge the second spool valve 62 to Position II. When the second spool valve 62 reaches Position II at time $t_5$, the high pressure fluid in the main chamber 26 exhausts through line 68, through the second spool valve 62 and through the first spool valve 34 into the low pressure line 56 and returning to the fluid tank 58, by the action of the engine valve spring 32 urging the engine valve 18 closed. The on/off flow control valves 81 and 92 are open so that both the second fluid chamber 30 and the third fluid chamber 75 are connected to the fluid tank 88, causing the low pressure fluid to fill chamber 30 as the engine valve 18 closes. The engine valve 18 begins closing by the action of the return spring 32 and the movement of fluid out of the main chamber 26. The time, t4, is determined by the control module 5 to achieve the desired valve opening time.

When the engine valve 18 approaches the closed position, the control module triggers the seating control by closing the second flow control on/off valve 92, at time $t_6$. The time, $t_6$, at which the control module closes the second on/off valve 92 is determined based upon when the valve has closed to a position-certain a predetermined lift from the closed position, depicted as $y_L$, typically about one (1) mm. When the engine valve approaches the desired predetermined lift distance from the closed position, as determined by input from sensor 102, the controller 5 energizes and closes the second on/off valve 92, disconnecting the fluidic connection between the third fluid chamber 75 and the fluid tank 88.

To reduce travel speed and effectively stop the engine valve 18 when it is returning to the closed position, the controller 5 energizes the second on/off valve 92 to the closed position, interrupting the fluid connection between the third fluid chamber 75 and the fluid tank 88. The engine valve 18 continues closing due to action of the spring 32. The movement of the first piston 28 forces flow of fluid from the third fluid chamber 75 into the fifth fluid chamber 78 via the feedback channel 74. The second spool valve 62 is moved to Position III when there is sufficient volumetric flow and corresponding pressure increase into the fifth fluid chamber 78. The movement of the second spool valve 62 to Position III terminates the fluid connection between the driving channel 68 and the intermediate channel 42. When the second spool valve 62 achieves Position III, the engine valve 18 stops, preferably in the closed position. In the alternate embodiment described hereinabove, the movement of the second spool valve to Position III restricts the fluid connection between the driving channel 68 and the intermediate channel. In both embodiments, the impact velocity of the engine valve at seating is reduced, resulting in a 'soft landing', and reduces valve noise.

The second on/off flow control valve 92 is then de-energized, at time $t_7$, which allows the second spool valve 62 return to Position II. The timing, i.e., time $t_7$, for de-energizing the second on/off valve 92 controls the seating velocity and closing timing of the engine valve 18. For example, the second on/off valve 92 is de-energized before the engine valve 18 reaches the valve seat, causing an early closing timing. To ensure precise valve closing timing, valve position is monitored through sensor 102 and the timings for energizing ($t_6$) and de-energizing ($t_7$) the second on/off flow control valve 92 are determined based on the valve position information. The control module precisely controls closing timing of the engine valve by controlling timing of deactivating the second on/off valve 92, at time $t_7$. There may be operating conditions during which signal output of the sensing device 102 includes noise, affecting its accuracy. Thus, if the engine valve remains open when the sensing device 102 indicates that the valve is closed at time $t_7$, the second on/off valve 92 is deactivated. This permits flow of hydraulic fluid to exhaust from chamber 75 to sump 88 to effect the closing of the engine valve at time $t_7$, regardless of the position of the engine valve indicated by the sensing device 102 The engine valve is urged toward and held in the closed position by the spring 32. This operation comprises the internal feedback mechanism controlling the engine valve closing.

The control module 5 repeats the above procedure during each valve opening/closing cycle for each engine valve. The control method provides precise closing timing control for both steady state and transient operations, without additional hardware.

Specific design aspects are apparent to a skilled practitioner, including determining hydraulic volumes and displacements necessary to achieve desired opening and closing velocities, achieve a dynamic range for valve opening and closing over the range of engine operating speeds, and, achieve an operating scheme which has resonant frequencies outside the dynamic range for valve opening and closing.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A method for operating an electro-hydraulic actuation mechanism operative to urge a moveable engine valve to a lift, comprising:

commanding the engine valve to a desired lift;

activating a first spool valve to permit flow of pressurized hydraulic fluid through a second spool valve to a main hydraulic chamber, the main hydraulic chamber configured to urge the engine valve to the desired lift;

monitoring lift of the engine valve; and commanding an on/off valve to a closed position when the monitored lift of the engine valve approaches the desired lift to effect flow of pressurized hydraulic fluid from one of a second and a third hydraulic chamber to a fluid chamber of the second spool valve, the second spool valve configured to terminate the flow of pressurized hydraulic flow from the first spool valve to the main hydraulic chamber to stop opening of the engine valve at the desired lift.

2. The method of claim 1, wherein commanding the on/off valve to the closed position when the monitored lift of the engine valve approaches the desired lift to effect flow of pressurized hydraulic fluid from one of the second and the third hydraulic chamber to the fluid chamber of the second spool valve comprises commanding the on/off valve to the closed position when the monitored lift is a predetermined distance from the desired lift.

3. The method of claim 1, wherein commanding the engine valve to the desired lift comprises commanding the engine valve to an open position.

4. The method of claim 1, wherein commanding the engine valve to the desired lift comprises commanding the engine valve to a closed position.

5. The method of claim 1, wherein activating the first spool valve to permit flow of pressurized hydraulic fluid through the second spool valve to the main hydraulic chamber to urge the engine valve to the desired lift further comprises exhausting pressurized hydraulic fluid from the second hydraulic chamber.

6. The method of claim 1, wherein the second spool valve is configured to terminate the flow of pressurized hydraulic flow from the first spool valve to the main hydraulic chamber to stop opening of the engine valve at the desired lift when there is sufficient flow of pressurized hydraulic fluid from one of the second and the third hydraulic chambers to the fluid chamber of the second spool valve.

7. A method for controlling a moveable engine valve to a desired lift, comprising:

equipping the moveable engine valve with an electro-hydraulic valve actuator assembly including a main hydraulic chamber, a second hydraulic chamber, first and second spool valves, and first and second on/off flow control valves, the electro-hydraulic valve actuator assembly operable to urge the engine valve to a lift;

commanding the engine valve to a desired lift, the desired lift corresponding to an open position;

controlling the first spool valve to permit flow of pressurized hydraulic fluid through the second spool valve to the main hydraulic chamber to urge the moveable engine valve to the desired lift;

monitoring lift of the engine valve; and commanding one of the first and second on/off flow control valves to a closed position when the monitored lift of the engine valve approaches the desired lift to effect flow of pressurized hydraulic fluid from the second hydraulic chamber to a fluid chamber of the second spool valve, the second spool valve configured to terminate the flow of pressurized hydraulic flow from the first spool valve to the main hydraulic chamber to stop opening of the engine valve at the desired lift.

8. The method of claim 7, wherein commanding one of the first and second on/off flow control valves to a closed position when the monitored lift of the engine valve approaches the desired lift to effect flow of pressurized hydraulic fluid from the second hydraulic chamber to a fluid chamber of the second spool valve comprises commanding the one of the first and second on/off flow control valves to the closed position when the monitored lift of the engine valve achieves a position-certain a predetermined distance from the desired lift.

9. The method of claim 7, wherein the second spool valve is configured to terminate the flow of pressurized hydraulic flow from the first spool valve to the main hydraulic chamber to stop opening of the engine valve at the desired lift corresponding to the closed position when there is a sufficient flow of pressurized hydraulic fluid from the second hydraulic chamber to the fluid chamber of the second spool valve.

10. A method for controlling closing of an open moveable engine valve, comprising:

equipping the moveable engine valve with an electro-hydraulic valve actuator assembly including a main hydraulic chamber, a second hydraulic chamber, a third hydraulic chamber, first and second spool valves, and first and second on/off flow control valves, the electro-hydraulic valve actuator assembly operable to urge the engine valve to an open position;

commanding the engine valve to a desired lift, the desired lift corresponding to the closed position;

controlling the first spool valve to permit flow of pressurized hydraulic fluid from the main hydraulic chamber through the second spool valve to a drain;

commanding the first on/off flow control valve to an open position to initiate closing of the engine valve;

monitoring lift of the engine valve; and commanding the second on/off flow control valve to a closed position when the monitored lift of the engine valve approaches the desired lift corresponding to the closed position to effect flow of pressurized hydraulic fluid from the third hydraulic chamber to a fluid chamber of the second spool valve, the second spool valve configured to terminate the flow of pressurized hydraulic flow from the first spool valve to the main hydraulic chamber to stop closing of the engine valve at the desired lift corresponding to the closed position.

11. The method of claim 10, wherein commanding the second on/off flow control valve to the closed position when the monitored lift of the engine valve approaches the desired lift corresponding to the closed position to effect flow of pressurized hydraulic fluid from the third hydraulic chamber to the fluid chamber of the second spool valve comprises commanding the second on/off flow control valve to the closed position when the monitored lift of the engine valve is a predetermined distance from the closed position.

12. The method of claim 10, wherein the second spool valve is configured to terminate the flow of pressurized hydraulic flow from the first spool valve to the main hydraulic chamber to stop opening of the engine valve at the desired lift corresponding to the closed position when there is a sufficient flow of pressurized hydraulic fluid from the third hydraulic chamber to the fluid chamber of the second spool valve.

* * * * *